US005816325A

United States Patent [19]

Hytken

[11] Patent Number: 5,816,325

[45] Date of Patent: Oct. 6, 1998

[54] METHODS AND APPARATUS FOR ENHANCED RECOVERY OF VISCOUS DEPOSITS BY THERMAL STIMULATION

[75] Inventor: Kent B. Hytken, San Diego, Calif.

[73] Assignee: Future Energy, LLC, San Diego, Calif.

[21] Appl. No.: 757,891

[22] Filed: Nov. 27, 1996

[51] Int. Cl.[6] ..... E21B 43/24; E21B 36/00

[52] U.S. Cl. ..... 166/303; 166/57; 166/67

[58] Field of Search ..... 166/303, 57, 67, 166/90.1

[56] References Cited

U.S. PATENT DOCUMENTS

| | | | |
|---|---|---|---|
| 2,914,124 | 11/1959 | Ripley, Jr. | 166/57 |
| 4,083,404 | 4/1978 | Allen | 166/303 X |
| 4,372,386 | 2/1983 | Rhodes et al. | 166/303 X |
| 4,378,846 | 4/1983 | Brock | 166/303 |
| 4,641,710 | 2/1987 | Klinger | 166/303 |
| 4,678,039 | 7/1987 | Rivas et al. | 166/303 |
| 5,085,275 | 2/1992 | Gondouin | 166/303 |

*Primary Examiner*—Hoang C. Dang
*Attorney, Agent, or Firm*—Lyon & Lyon LLP

[57] ABSTRACT

Method and apparatus for enhanced recovery of subterranean deposits. A heating fluid circulates in a concentric tubing assembly which attaches to a downhole heat exchanger. A convertible fluid descends to the downhole heat exchanger in the concentric tubing assembly where it converts to vapor by transfer of heat from the heating fluid. The vapor can then be used to liquefy viscous subterranean deposits. A feed control valve controls the rate at which convertible fluid enters the downhole heat exchanger. Scale produced by the vaporization of the convertible fluid is purged by a purging valve into the well sump.

8 Claims, 1 Drawing Sheet

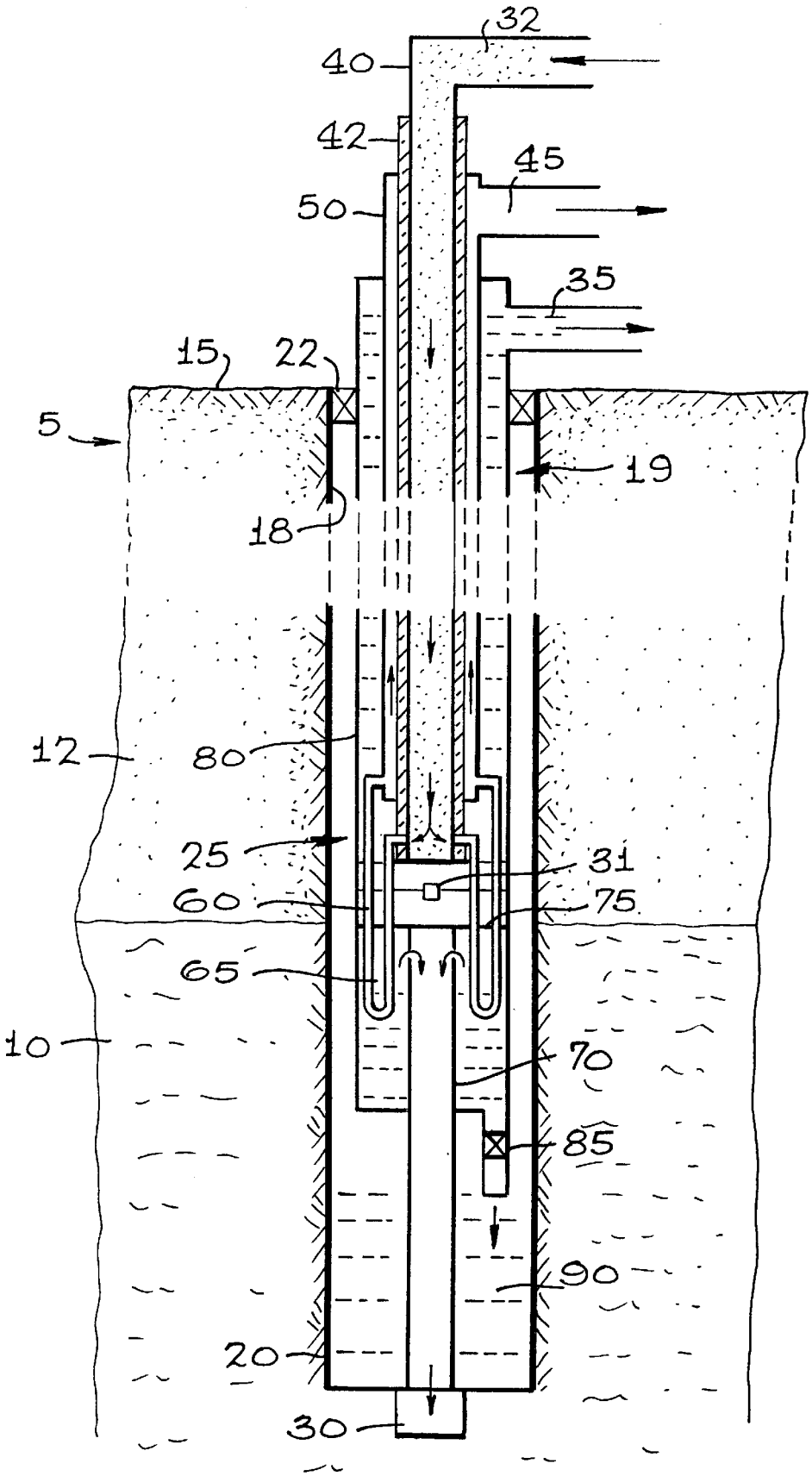
32
40
42
45
50
35
15
22
5
19
18
12
80
25
31
60
75
65
10
70
85
90
20
30

METHODS AND APPARATUS FOR ENHANCED RECOVERY OF VISCOUS DEPOSITS BY THERMAL STIMULATION

BACKGROUND OF THE INVENTION

This invention relates to methods and apparatus for recovery of viscous oil deposits and in particular to the method disclosed by Klinger, U.S. Pat. No. 4,641,710 which is hereby incorporated by reference herein.

Klinger, U.S. Pat. No. 4,641,710, describes a downhole heat exchanger which generates vapor to liquefy viscous oil deposits. A surface heater located at the wellhead heats a heating fluid which is then pumped down a closed tubing to the oil-bearing strata where the tubing ends in a "u-turn" before ascending back to the surface heater. A convertible fluid such as water is flashed on the hot tubing just above the "u-turn" to generate vapor. The vapor continues to absorb heat along the lower portion of the "u-turn" before entering the oil-bearing strata.

This prolonged heating of the vapor ensures that the vapor, as it enters the oil-bearing strata, is of very high quality or even superheated depending on the relative rates of the heating and convertible fluids.

Gondouin, U.S. Pat. No. 5,085,275, describes twin horizontal drainholes which operate in a cyclic "huff and puff" mode through the use of a three-way steam valve section. A surface-mounted steam boiler generates steam which is injected down a tubing in the well to the three-way valve section. The valve section directs steam to one of the horizontal drainholes which then functions in the "puff" mode creating a hot mobile oil zone around the drainhole as a result of the injected steam. The valve then switches so that the drainhole functions in the "huff" mode, withdrawing the hot mobile oil. At the same time, the opposite drainhole operates in the "puff" mode.

Gondouin also describes tubing arrangements within the borehole which reduce heat loss from the steam injection tubing into the cold rocks which surround the well casing. In one embodiment, both the steam injection line and the production line carrying the heated oil are suspended within the gas-filled well casing. Because the production line contains the heated oil resulting from the steam injection, it warms the gas within the casing and reduces the temperature gradient across the steam injection tubing. In another embodiment, the production tubing is concentric with the steam injection tubing, the steam tubing being inside the production tubing. This concentric tubing arrangement is suspended within the gas-filled well casing.

TERMINOLOGY

The following terms are used in this disclosure and claims:

Subterranean Deposits: Underground viscous deposits which can be liquefied by thermal stimulation from a heated vapor.

Surficial Layer: That layer of earth between the surface and the subterranean deposits.

Borehole: The hole resulting from conventional drilling for underground deposits.

Well casing: Tubing which fills and seals the wall of the borehole.

Heating Fluid: A suitable fluid for supplying heat to create vapor which can liquefy the subterranean deposits.

Convertible Fluid: A suitable fluid which is converted to vapor by heat exchange from the heating fluid in order to liquefy the subterranean deposits.

Concentric Tubing Assembly: Concentrically arranged tubing which carries the heating fluid and the convertible fluid to a downhole heat exchanger.

Downhole Heat Exchanger: Apparatus located in the borehole within or adjacent to the subterranean deposits wherein the convertible fluid is converted to vapor by heat exchange from the heating fluid.

SUMMARY OF THE INVENTION

This invention features a downhole heat exchanger which generates vapor to liquefy viscous deposits. A heating fluid is heated by a surface-mounted surface heater to a temperature sufficient for downhole conversion at the heat exchanger of a convertible liquid to vapor. The heating fluid descends to the heat exchanger and ascends back to the surface heater in a concentric tubing.

In one embodiment, the heating fluid, typically molten sodium chloride, descends to the heat exchanger in an insulated inlet tubing. The molten salt ascends from the heat exchanger to the surface in an outlet tubing concentric with and containing the inlet tubing. Other heating fluids which are acceptable include oil, Dow Therm, or water.

The convertible fluid, preferably water, descends to the heat exchanger for vaporization in an feed tubing concentric with and containing the outlet tubing. Other suitable convertible fluids include diesel oil or gas oil.

The entire concentric assembly is suspended in the low-pressure gas-filled well casing. This suspension reduces heat loss from the feed tubing to the cold rocks surrounding the well casing. The concentric assembly offers several other advantages as well.

First, unlike the method disclosed by Klinger, U.S. Pat. No. 4,641,710, only the inlet tubing need be insulated. Because the insulated tubing is at least five times more expensive than bare tubing, this represents a major cost savings over that design.

Second, the arrangement of the feed tubing concentrically containing the uninsulated outlet tubing allows the convertible fluid to be efficiently pre-heated before entering the downhole heat exchanger. This pre-heating of the convertible fluid occurs using the surface of the outlet tubing alone with the convertible fluid and the heating fluid in an efficient counter-current flow.

Third, because this concentric tubing assembly provides for efficient pre-heating of the convertible fluid, the design of the heat exchanger is simplified. The heat exchanger now needs only provide the latent heat of vaporization, the necessary sensible heat having been acquired as the convertible fluid descends the length of tubing towards the downhole heat exchanger. The necessary heat exchange surfaces in downhole heat exchanger are smaller than in the previous method disclosed by Klinger, U.S. Pat. No. 4,641,710, which again lowers the manufacturing costs.

Other features and advantages of the invention will be apparent from the following description of the preferred embodiment thereof, and from the claims.

BRIEF DESCRIPTION OF THE DRAWINGS

The FIGURE is a diagrammatic representation, in a section of an earth formation, of a concentric tubing assembly attaching to a downhole heat exchanger.

DETAILED DESCRIPTION OF THE PREFERRED EMBODIMENT

The earth formation 5 shown in FIG. 1 includes a subterranean deposit 10 below a surficial layer 12 topped by a surface 15 which typically is the surface of the earth.

Extending through the surficial layer 12 into the subterranean deposit 10 is a borehole 18 which can be formed by conventional oil exploration drilling techniques. In usual operation, borehole 18 is filled or encased by a tubular well casing 20.

Within borehole 18, a concentric tubing assembly 19 is suspended from a well head 22. Concentric tubing assembly 19 then descends to a downhole heating apparatus 25 wherein vapor 30 is generated by transfer of heat from a heating fluid 32, which preferably is a molten salt, to a convertible fluid 35, preferably water.

Heating fluid 32 enters an inlet tubing 40 at the well head 22 and descends to downhole heating apparatus 25. Inlet tubing 40 is insulated by insulation 42. At downhole heating apparatus 25, inlet tubing 40 connects to a heat exchanger tubing 60 within a steam collector portion 65 of the downhole heating apparatus 25. Heat from heat exchanger tubing 60 vaporizes convertible fluid 35 within steam collector portion 65. Vapor 30 enters the steam collector tubing 70 near a shell 75 so that the steam is maintained at high quality or even superheated by heat from the downward-extending heat exchanger tubing 60. Vapor 30 can then be used to liquefy a subterranean deposit 10 by a conventional steam flood method or by the huff and puff technique.

After passing through downhole heating apparatus 25 in heat exchanger tubing 60, return heating fluid 45 ascends borehole 18 in the an outlet tubing 50 which contains insulated inlet tubing 40. At surface 15, return heating fluid 45 is reheated in a surface heater (not shown) and pumped back down insulated inlet tubing 40 as heating fluid 32.

The same surface heater can be used to preheat convertible fluid 35 within a conventional economizer tubing (not shown) before pumping down a feed tubing 80 to downhole heating apparatus 25. Feed tubing 80 contains outlet tubing 50. Unlike inlet tubing 40, outlet tubing 50 is not insulated. In this way, convertible fluid 35 is continually and efficiently heated within feed tubing 80 by the still-hot return heating fluid 45 using as the heat exchange surfaces the wall of outlet- tubing 50 alone. Because this heat exchange continues until convertible fluid 35 enters downhole heating apparatus 25 , downhole heating apparatus 25 need only provide the latent heat of vaporization, the necessary sensible heat being provided by concentric tubing assembly 19. In turn, downhole heating apparatus 25 design is simplified and production costs lowered because heat exchanger tubing 60 can be shorter as it need only provide the latent heat of vaporization.

Feed tubing 80 requires no insulation because its heat loss through the well casing 20 is reduced by suspension the within low-pressure gas-filled borehole 18. Thus, the only insulation required is on inlet tubing 40.

A feed valve 31 controls the rate of convertible fluid 35 into downhole heating apparatus 25. Feed valve 31 responds to the pressure differences between the convertible fluid 35 at the base of feed tubing 80 and the vapor pressure within the steam collector 65 portion of downhole heating apparatus 25 so that vapor quality is maintained at a high value.

Scale buildup on downward extension tubing 60 is reduced because of the narrow diameter of this tubing which causes the scale to periodically slough off. This sloughed-off scale then builds up at the base of heating apparatus 25. A purging valve 85 is periodically opened to drain this accumulated scale into an oil sump 90 of the well. In addition, conventional scale removing chemicals can be added to the hot water 50 at the surface before pumping to the heating apparatus 25.

The foregoing description illustrates specific applications of the invention. Other useful applications of the invention which may be a departure from the specific description will be apparent to those skilled in art. Accordingly, the present invention is not limited to those examples described above.

I claim:

1. A process for supplying a vapor from conversion of a convertible fluid within a subterranean deposit by thermal stimulation from a heating fluid wherein the heating fluid and the convertible fluid are contained within concentric tubing inside a hole extending from the subterranean deposit to a surface of a surficial layer remote from the subterranean deposit, comprising the steps of:

heating the heating fluid to a temperature sufficient for conversion of the convertible liquid to a vapor inside the hole in the subterranean deposit by a transfer of heat from the heating fluid to the convertible liquid;

advancing the convertible liquid and the heating fluid within the concentric tubing from the surface to the subterranean deposits to connect to a heat exchanger wherein heat from the heating fluid converts the convertible liquid into the vapor; and returning the heating fluid within the concentric tubing for reheating.

2. A process according to claim 1 wherein the concentric tubing is arranged such that the heating fluid advances from the surface to the heat exchanger within an inlet tubing inside and substantially concentric with an outlet tubing, and the heating fluid ascends to the surface from the heat exchanger in the outlet tubing which is inside and substantially concentric with a feed tubing, and wherein the convertible fluid advances from the surface to the heat exchanger within the feed tubing.

3. A process according to claim 2 wherein the downhole heat exchanger contains a feed valve which controls the feed rate of the convertible fluid entering the downhole heat exchanger, and wherein the heat exchanger contains a purging valve so that accumulated scale produced by vaporization of the convertible fluid can be purged from the heat exchanger into an oil well sump.

4. A process according to claim 3 wherein at least the inlet tubing is insulated, and wherein the convertible fluid is water and the heating fluid is a molten salt.

5. Apparatus for supplying a vapor from conversion of a convertible fluid within a subterranean deposit by thermal stimulation from a heating fluid inside a hole extending from a surface of a surficial layer remote from the subterranean deposit, comprising:

concentric tubing within the hole for supplying the heating fluid and the convertible liquid from the surface to the subterranean deposit and for returning the heating fluid from the subterranean deposit to the surface; and a heat exchanger connected to the concentric tubings wherein heat from the heating fluid converts the convertible liquid into the vapor.

6. The apparatus of claim 5 wherein the concentric tubing is arranged such that the heating fluid advances from the surface to the heat exchanger within an inlet tubing inside and substantially concentric with an outlet tubing, and the heating fluid ascends to the surface from the heat exchanger in the outlet tubing which is inside and substantially concentric with a feed tubing, and wherein the convertible fluid advances from the surface to the heat exchanger within the feed tubing.

7. The apparatus of claim 6 wherein the downhole heat exchanger contains a feed valve which controls the feed rate of the convertible fluid entering the downhole heat exchanger, and wherein the heat exchanger contains a purging valve so that the accumulated scale produced by vaporization of the convertible fluid can be purged from the heat exchanger into an oil well sump.

8. The apparatus of claim 7 wherein at least the inlet tubing is insulated and wherein the convertible fluid is water and the heating fluid is molten salt.

* * * * *